US005249705A

United States Patent [19]

Gates

[11] Patent Number: 5,249,705

[45] Date of Patent: Oct. 5, 1993

[54] COUPON DISPENSER

[75] Inventor: Lawrence B. Gates, Vernon, N.J.

[73] Assignee: Paul A. Wiebel, McAfee, N.J.

[21] Appl. No.: 929,697

[22] Filed: Aug. 12, 1992

[51] Int. Cl.[5] ..... G07F 11/36

[52] U.S. Cl. ..... 221/6; 221/15; 221/26; 221/71; 221/259; 221/283

[58] Field of Search ..... 271/126; 221/2, 3, 6, 221/15, 17, 26, 13, 71, 259, 283

[56] References Cited

U.S. PATENT DOCUMENTS

| | | | |
|---|---|---|---|
| 2,274,238 | 2/1942 | Henderson et al. | 221/283 X |
| 3,981,497 | 9/1976 | Feinstein et al. | 271/126 |
| 4,041,480 | 8/1977 | Boyle | 221/6 |
| 4,209,108 | 6/1980 | Winans | 221/6 |
| 4,530,200 | 7/1985 | Prewer | 221/259 X |
| 4,637,523 | 1/1987 | Levasseur | 221/13 |
| 4,696,462 | 9/1987 | Tanaka et al. | 271/126 X |
| 4,832,328 | 5/1989 | Graham | 221/259 X |
| 5,065,894 | 11/1991 | Garland | 221/71 X |
| 5,097,981 | 3/1992 | Degasperi et al. | 221/3 |
| 5,119,969 | 6/1992 | Haber | 221/71 |

*Primary Examiner*—Robert P. Olszewski
*Assistant Examiner*—Dean A. Reichard

[57] ABSTRACT

A push button coupon dispenser comprises a housing having a roll of coupons, a coupon ejection slit, a battery, a motor and a push button electrically connected to the battery and the motor for activating the motor. The housing further includes a coupon advancing means having a guide means to guide the coupon to the ejection slit, and a timer to provide a time delay between each coupon ejection. A coupon sensor detects the presence or absence coupons at the exit slit. The coupon dispenser is mounted on a smooth surface at the point of purchase by means of a suction-cup mount plate.

13 Claims, 3 Drawing Sheets

COUPON DISPENSER

FIELD OF THE INVENTION

This invention relates to a coupon dispenser and is particularly related to a push-button coupon dispenser for dispensing promotional and advertising redemption coupons and the like at the point of sale and purchase of products.

BACKGROUND OF THE INVENTION

Traditionally, television and newspaper media have provided the major sources of advertising and product promotions for the consumer. Clipping redeemable coupons from newspapers and trade publications is a matter of common household practice. This requires that the coupon be clipped from the newspaper or the publication and presented for redemption at a particular store or location.

As disclosed in U.S. Pat. No. 5,097,981 issued to Degasperi et al on Mar. 24, 1992, consumer redemption of redeemable coupons has steadily decreased in recent years. This decrease in consumer redemption has prompted some manufacturers and advertising establishments to turn to other means of promotion, the most notable of which is the point-of-sale (POS) or point-of-purchase (POP) advertising. Both POS and POP advertising methods contemplate the distribution of redeemable coupons at the source of sale and distribution of the product. According to the statistics revealed in said patent, these methods have resulted in "300–600% increase in product movement typically experienced in the day of an in-store product demonstration." Encouraged by these statistics, retailers have been motivated to develop a coupon dispenser for dispensing product redemption coupons in retail stores and supermarkets where the dispenser is displayed on the store shelf featuring the product. One such dispenser, referred to in said Degasperi et al patent as the point-of-purchase coupon dispenser (POP-CD), is described in that patent. As described therein, the POP-CD comprises a coupon storage compartment, coupons, coupon exit means, means for ejecting the coupon from the compartment, an audio/visual means (a buzzer or a blinking light) for attracting the attention of the consumer and an activation mechanism having "consumer sensing means" which senses the presence of a consumer. The consumer sensing means is operatively connected to both the audio/visual means and the means for ejecting the coupons. Thus, when the presence of the consumer is sensed by the consumer sensing means, both the audio/visual means and the coupon ejection means are activated and the coupon is thus dispensed from the dispenser. The dispenser is shut off when the consumer steps away so that the consumer sensing means can no longer sense her or his presence.

Other coupon dispensing machines are known and described in several patents. These include U.S. Pat. Nos. 3,260,402; 4,039,181; 4,530,200; and 4,717,043.

The prior art coupon dispensers, however, are either complicated and expensive to construct or difficult and unreliable to operate. Thus, the need still exists for a simple, compact and reliable coupon dispenser.

Accordingly, it is an object of this invention to provide a coupon dispenser which can be used for dispensing product promotional coupons for redemption by the consumer at the point of purchase.

It is another object of this invention to provide a compact coupon dispenser which can be conveniently installed on a shelf in a retail store and which dispenses redemption coupons by simply pressing a button visibly located on one of the exterior surfaces of the dispenser.

It is still another object of this invention to provide a coupon dispenser in combination with a mounting means for securely mounting the dispenser on a shelf in the retail store.

It is also an object of this invention to provide a coupon dispenser in combination with a mounting plate wherein the mounting plate has a surface comprising one or more suction sups adapted to securely grip the surface on which the dispenser is mounted.

The foregoing and other features and advantages of the present invention will be appreciated from the ensuing detailed description thereof together with the accompanying drawings.

SUMMARY OF THE INVENTION

In accordance with this invention a coupon dispenser is provided having a push button for activating the coupon dispensing mechanism. The coupon dispenser comprises a housing which accommodates a roll of coupons and has a coupon ejection slit through which the coupons are ejected from the housing. An electric power source (e.g., battery) and a motor are also housed within the housing, and a button mounted on the exterior of the housing is electrically connected to the power source and the motor to activate said motor. A coupon advancing means in the housing includes a guide means to guide the coupons to the coupon ejection slit.

A timer means is electrically connected to the button, power source and motor to provide a selected time delay between each coupon ejection.

A coupon sensing means is provided in the housing near the coupon ejection slit having a light emitting diode, and spaced therefrom, a photodetector in order to sense the presence or absence of a coupon.

In order to mount the coupon dispenser on a smooth surface, the coupon dispenser further comprises hinge means and a suction-cup mounting plate. The suction cup or cups serves to suctionally engage the mounting plate onto a smooth surface in a retail store or other points of purchase.

BRIEF DESCRIPTION OF THE DRAWINGS

In the drawings, wherein like reference numerals are employed to designate like parts.

DETAILED DESCRIPTION OF THE INVENTION

Figure 1:
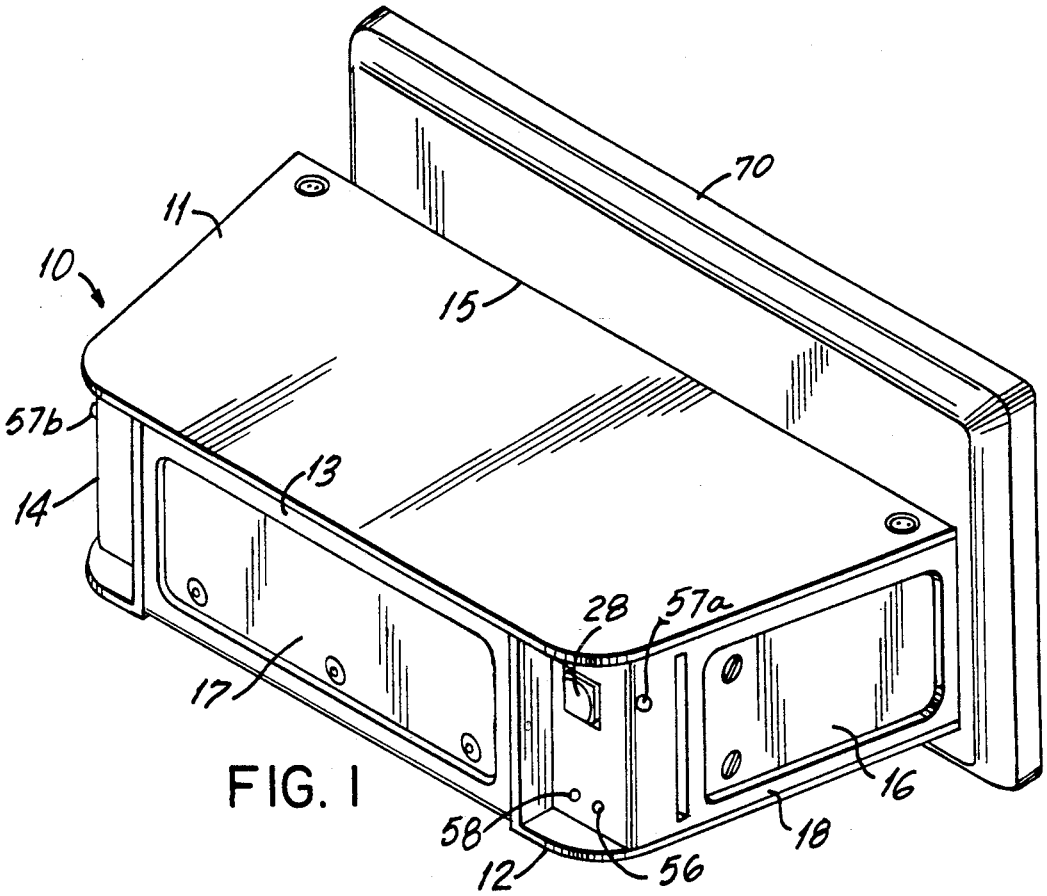
FIG. 1 is a perspective view of the coupon dispenser of the present invention as mounted on a product display shelf.

As shown in FIGS. 1-5 the coupon dispenser of the present invention includes a housing 10, preferably formed of a suitable plastic resin although, alternatively, the housing may be made of sheet metal if desired.

The housing 10 has a top panel 11 which can swing open about a piano hinge 11A (see FIG. 2), an opposite bottom panel 12 spaced therefrom, and first, second, third and fourth sidewalls 13-16. The front sidewall 13 has a display panel 17 into which an advertisement related to the coupon may be placed. Sidewall 16 has a similar advertising display panel 18.

An elongated slit 19 is provided in the sidewall 16 and provides the exit means for the coupons 20. The coupons 20 are wound on a reel 21 having a central core 22 which is held on a tubular mandrel 23 (see FIG. 2). The mandrel 23 is secured to and is rotatably mounted on the bottom panel 12 by a screw 24.

The coupon advancing mechanism is within the compartment 25 in the housing 10. The compartment 25 carries the removable battery power source 26, (a conventional 9 volt battery), the main PCB (Printed Circuit Board) **27*a* and a smaller PCB 27*b*, a customer operable button 28 which extends through a hole in the sidewall 13 so it may be pushed by the user to obtain a coupon. The battery contacts are in electrical contact with the spring contacts 29*a* and 29*b*, and the PCB's 27*a* and 27*b* are in electrical contact with each other by means of the rubber harness 27*c***.

Figure 3:
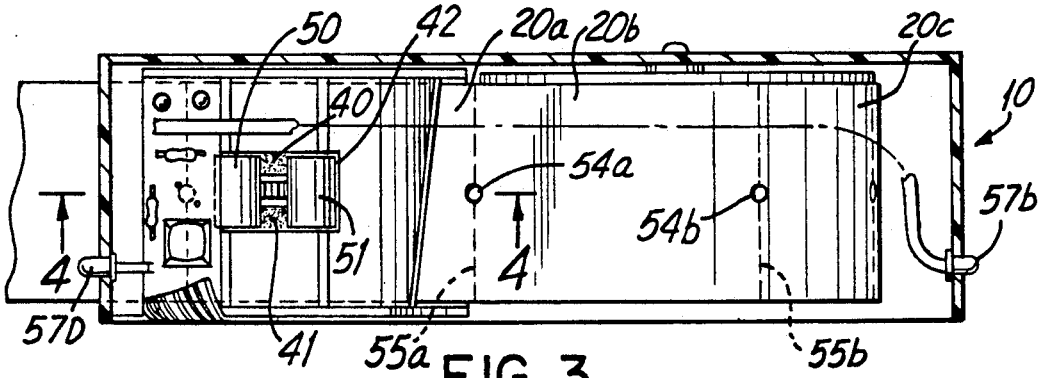
FIG. 3 is a front sectional view taken along the line 3—3 of FIG. 2.
Figure 4:
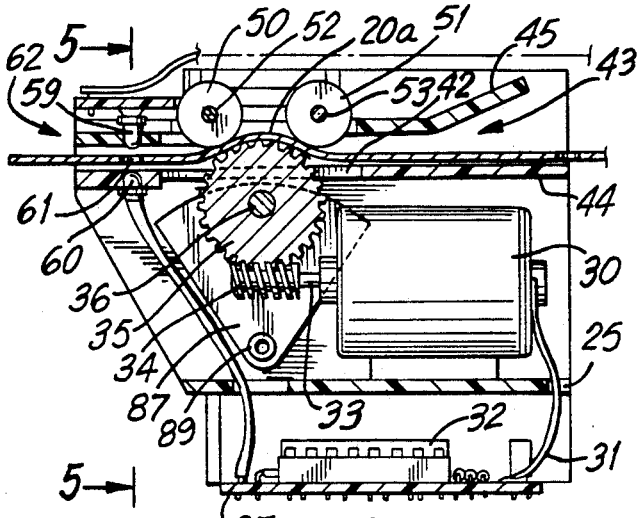
FIG. 4 is a side sectional view of the dispensing mechanism taken along the line 4—4 of FIG. 3.
Figure 5:
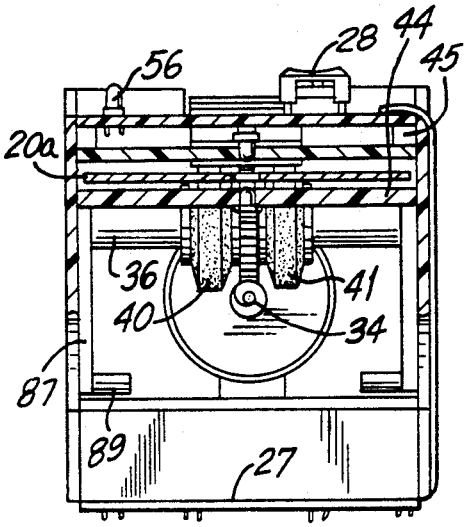
FIG. 5 is a sectional view of the left side of the dispensing mechanism taken along the line 5—5 in FIG. 4.
Figure 6:
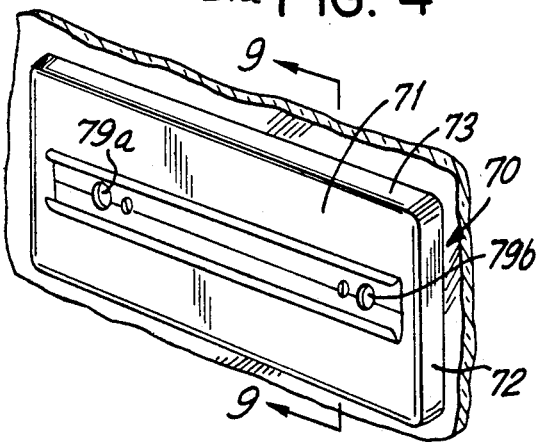
FIG. 6 is a front elevational view of the suction-cups mount plate mounted on a typical shelf surface in a retail store.

As shown in FIGS. 3-5 an electric motor 30 is mounted in compartment 25 and is connected to the PCB **27*a* by the wires 31*a* and 31*b*. A microprocessor 32 is mounted on PCB 27*a* and controls the operation of the motor 30. The motor 30 has a rotatable output shaft 33 upon which a worm screw 34 is fixed. The worm screw 34 is in mesh with a worm drive gear 35 which is fixed to a shaft 36. The ends of the shaft 36 are rotatably mounted in the cam plate 87. The cam plate 87 pivots about the cam axis 89 such that rollers 40 and 41 serve to drive wheel 51 when a ticket passes between roller 40 or 41 and wheel 51, and engages drive wheel 50 when the user pulls out the ticket to be dispensed, thus allowing the perforations to be broken when sufficient pull force is applied. The cam plate 87** remains in a middle position when the coupon exit is blocked and thus does not engage either roller.

Two high-friction rollers 40 and 41 are fixedly mounted on the shaft 36 on opposite sides of the worm gear 35. The circumferential surfaces of the rollers 40 and 41 are preferably made of rubber. The rollers 40, 41 protrude through an opening 42 in the coupon guide 43.

The coupon guide 43 consists of an upper plate 45 and, spaced therefrom, a lower plate 44 with portions of the plate 45 being flat and the plate 44 being flat and the two flat portions of the plates 44, 45 being parallel.

Two wheels, a main drive wheel 50 and a positive brake wheel 51 are rotatably mounted on fixed axles 52, 53, respectively. The wheels 50, 51 are positioned in the opening 42 above the high-friction rollers 40, 41 and are parallel to each other and have a gap therebetween.

Figure 2:
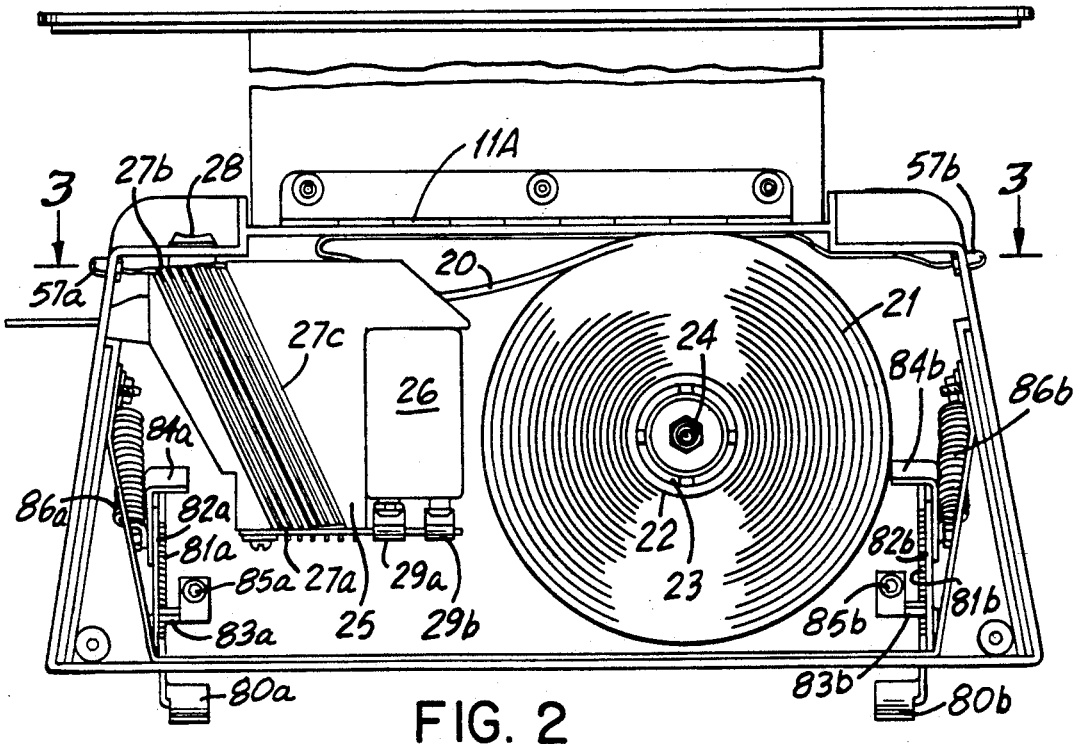
FIG. 2 is a top view of the coupon dispenser of FIG. 1 with the top lid removed to show the coupon roll, the dispensing mechanism and other major components of the coupon dispenser.

The coupon roll consists of individual rectangular paper coupons **20*a*, 20*b*, 20*c*, etc., formed into a coupon roll (see FIGS. 2 and 3). A sensing hole 54*a*, 54*b*, etc., is formed, preferably as a round hole, by semi-circle indentations in both opposite edges of each coupon. The coupons are joined by score lines 55*a*, 55*b***, etc.

Two high-intensity LEDs (Light Emitting Diodes) **57*a*, 57*b* protrude through holes in the housing 10** and are powered from the PCB's so that they blink on-and-off, for example at a 1-5 Hz rate. The LED's only function is to attract the attention of consumers to the coupon dispenser.

Another LED is used as the empty coupon light 56, to indicate that the coupon roll has been used up. It is controlled by the PCB (from the microprocessor) and depends upon the coupon sensing circuitry, described below. The wait light 58 is a LED, controlled by the PCB, to show that there are coupons in the dispenser, but that the user must wait a pre-selected time until the button is effective to eject the next coupon.

The coupon sensing circuitry 62 includes a LED 59 which is on when the coupon dispenser is in operation. An IR (Infra-Red) photoresponsive sensing device 60, preferably a photo-diode or photo-transistor, is positioned across a gap 61 from the LED 59. If a coupon is ready to be ejected from the dispenser it will be within the gap 61. If the body of a coupon is in the gap 61 the light from LED 59 does not reach the photoresponsive device 60 and consequently, the coupon sensing circuitry senses the presence of light through the coupon hole **54*a*** in the gap or the end of the coupon roll.

To prevent a user from holding down the button and collecting one coupon immediately after the other, a time delay means is included. A pre-selected time must elapse before the button 28 is effective to eject the next coupon after the previous coupon has been ejected. In one preferred embodiment the time delay is firmware programmed into the microprocessor 32. The microprocessor may be programmed with a firmware routine so that if the button is operated and the sensing circuitry 62 does not change state, from empty gap to filled gap, the empty coupon light 56 is activated. The empty coupon light 56 is deactivated when new coupons are placed in the dispenser, and the coupon sensing circuitry senses a coupon instead of a hole in gap 62 and change to a coupon-present state. The timing to operate the motor may be firmware controlled programmed; but preferably is controlled by the sensing circuitry 62 detecting light passing through the hole **54*a* and turning off the motor 30**.

Figure 7:
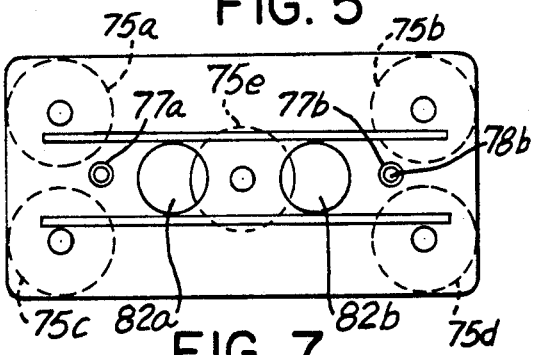
FIG. 7 is a top view of the suction-cups mount plate.
Figure 8:
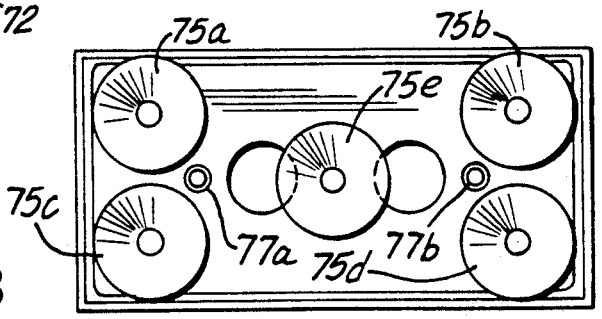
FIG. 8 is a rear view of the suction-cups mount plate.

In order to mount the coupon dispenser on a smooth surface, a mount plate 70 is provided as shown in FIGS. 1 and 6-9. The mount plate 70 which is also preferably formed of a suitable plastic, is defined by an outer generally flat surface 71, a circumferential edge 72 and an opposite parallel surface 73 which is recessed relative to the edge 72. A generally flat plastic bracket member 74 is screwed to said mount plate and has an outer surface **74*a* and an opposite parallel inner surface 74*b*. As shown in FIGS. 7 and 8, five suction cup-like members 75*a*-75*e* are securely fixed to the inner surface 74*b* of said flat bracket member 74. The suction cup-like members 75*a*-75*e* are made of an elastomeric material such as rubber or rubber-like plastic resin for suctional engagement onto a smooth surface 76** and serve to grip the surface on which the mount plate is to be mounted.

Two standoffs **77*a*, 77*b* each having an internal screw threaded bore 78*a*, 78*b*, respectively, are fixed to the plastic bracket member 74 and secure this member to the mount plate 70. Screws 79*a*, 79*b* which are screwed into the respective bores 78***a*, 78*b* hold the elongated U-shaped channel strip 79 to the outer surface 71 of the mount plate 70.

A pair of spaced apart parallel support bars 89*a*, 89*b* are secured along the longitudinal axis of the outer surface of the mount plate 70 (see FIG. 7) and serve to impart structural rigidity to the mount plate 70. Preferably, the support bars 89*a*, 89*b* have the same height as the standoffs 77*a*, 77*b*. Access holes 82*a*, 82*b* provide finger access for lifting and disengaging the bracket member 74 from the mount plate.

Figure 9:
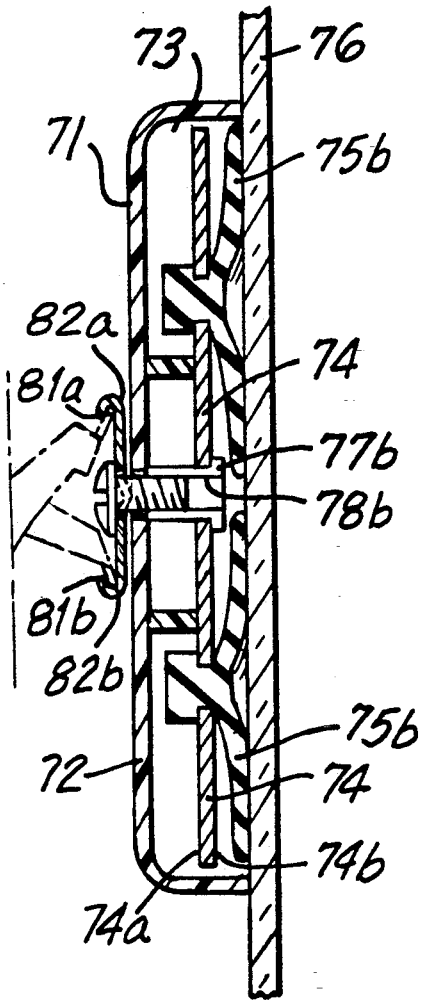
FIG. 9 is a side sectional view taken along the line 9—9 of the mount plate shown in FIG. 6.

As shown in FIGS. 2 and 9, the coupon dispenser is provided with means for engaging the dispenser into the U-shaped channel strip 79 or similar channel strips found in retail store shelves. This means comprises two pairs of jaws 80*a*, 80*b* protruding from the bottom of the dispenser at opposite ends thereof of such pair of jaws are provided, one pair on each side of the dispenser, although only one jaw is visible as shown in FIG. 2. Each of the jaws forms the free end of the posts 81*a*, 81*b* with each pair of posts being biased upwardly or downwardly in a scissor-like action by moving the thumb control lever 84*a*, 84*b*. Lock screws 85*a*, 85*b* are used to spread the jaws 80*a*, 80*b* into the upper and lower c-channels 82*a*, 82*b* (see FIG. 9).

As is also shown in FIG. 2, the coupon dispenser is also conveniently provided with the safety springs 86*a*, 86*b* which are fixed inside the housing 10 at opposite side walls. The safety springs 87*a*, 87*b* are secured at their upper ends to the tilt adjustor bars 88*a*, 88*b* and at their lower ends to the side walls. This permits the dispenser to be tilted somewhat if pulled from the shelf without dislodging the unit.

The jaws 80*a*, 80*b* are adapted to engage into the U-shape channel strip 79 when mounting the coupon dispenser on the mount plate, or into similar channel strips found on retail store shelves.

While the coupon dispenser of this invention has been described with certain degree of particularity, it is apparent that several changes and modifications may be made therein which are obvious from the present disclosure. It must also be understood that in its broadest aspect, the coupon dispenser, per se, need not include the jaws and hinge assembly described herein and may be simply placed upon a shelf or fixed to a wall by means of brackets or similar means. However, the hinge means described herein provide a safer and more tamper proof unit for installation at various retail stores.

What is claimed is:

1. A push button activated coupon dispenser comprising:

a housing having an internal cavity adapted to store a roll of coupons to be dispensed, and a coupon ejection slit through which the coupons are ejected from the housing;

a battery power source within the housing, an electric motor within the housing having a rotatable output shaft, an operable control button mounted on the exterior of the housing and electrically connected to the power source and the motor so that activation of the button operates the motor;

a coupon advancing means within the housing cavity comprising; motor gear means fixed to the motor shaft, a rotatably mounted gear shaft, a drive gear fixed to said gear shaft and in mesh with said motor gear means, at least one high-friction roller fixed to the gear shaft, two freely rotatable rollers, a guide means to guide the coupons to the ejection slit including two parallel plates having an opening therebetween, said parallel plates adapted to guide coupons therebetween, the high friction roller being normally positioned on one side of a coupon and protruding into the opening, and the freely rotatable rollers being normally positioned on the opposite side of a coupon, wherein rotation of the high friction roller advances a coupon through the parallel plates to the ejection slit.

2. A coupon dispenser as in claim 1 further including a timer means electrically connected to the button, power source and motor to provide a selected delay time between each operation of the button so that a coupon is ejected only after the selected delay time has elapsed since the previous coupon was ejected and coupon selection means to operate the motor for a selected operation time to eject a single coupon on each operation of the button.

3. A coupon dispenser as in claim 2 further including a coupon present light electrically controlled by the coupon sensing means and mounted on the exterior of the housing to indicate presence of a coupon in the dispenser.

4. A coupon dispenser as in claim 1 further including coupon sensing means within the housing cavity comprising, connected to the power source, a light emitting diode, and spaced therefrom across a gap normally occupied by a coupon, a photodetector.

5. A coupon dispenser as in claim 1 further including an empty light electrically controlled by the coupon sensing means and mounted on the exterior of the housing to indicate the absence of coupons in the coupon dispenser.

6. A coupon dispenser as in claim 1 wherein the high-friction roller has a rubber circumferential surface.

7. A coupon dispenser as in claim 1 further including means for securing said dispenser to a mounting means for mounting on a smooth surface, said mounting means comprising;

(a) an integral generally lid-like member defined by an outer generally flat surface, a circumferential edge and opposed, parallel surfaces recessed relative to said circumferential edge, (b) a U-shaped channel member along the longitudinal axis of said member disposed generally midway on said outer surface of said member and means for securing said channel member to said lid-like member, (c) a generally flat member secured within the recessed surface of said lid-like member, said flat member having an outer surface and an opposed parallel inner surface, and (d) at least one generally cup-shaped elastomeric member secured to said flat member for suction engagement onto a wall surface.

8. A push button activated coupon dispenser to dispense coupons having indentations in opposite edges thereof, comprising;

a roll of coupons, each coupon having indentations in opposite edges thereof such that said indentations form a hole between the adjoining coupons, a housing having an internal cavity adapted to store the roll of coupons to be dispensed, and a coupon ejection slit through which the coupons are ejected from the housing;

a battery power source within the housing, an electric motor within the housing having a rotatable output shaft, an operable control button mounted on the exterior of the housing and electrically connected to the power source and the motor so that activation of the button operates the motor;

a coupon advancing means within the housing cavity comprising; motor gear means fixed to the motor shaft, a rotatably mounted gear shaft, a drive gear fixed to said gear shaft and in mesh with said motor gear means, at least one high-friction roller fixed to the gear shaft, the high friction roller being normally positioned on one side of a coupon to advance a coupon toward the ejection slit and a photoresponsive means for detecting the presence of the holes between adjoining coupons.

9. A coupon dispenser as in claim 8 further including a timer means electrically connected to the button, power source and motor to provide a selected delay time between each effective operation of the button so that a coupon is ejected only after the selected delay time has elapsed since the previous coupon was ejected and coupon selection means to operate the motor for a selected operation time to eject a single coupon on each operation of the button, the photoresponsive means including a light source positioned respectively on opposite sides of a travel path of the coupons to detect the indentations in the coupon.

10. A coupon dispenser as in claim 9 wherein the light source is a light emitting diode, and spaced therefrom across a gap normally occupied by a coupon, a photodetector is the photoresponsive means.

11. A coupon dispenser as in claim 9 further including an empty light electrically controlled by the coupon sensing means and mounted on the exterior of the housing to indicate the absence of coupons in the coupon dispenser.

12. A coupon dispenser as in claim 9 further including a coupon present light electrically controlled by the coupon sensing means and mounted on the exterior of the housing to indicate presence of a coupon in the dispenser.

13. A coupon dispenser as in claim 8 wherein the high-friction roller has a rubber circumferential surface.

* * * * *